US005212841A

United States Patent [19]

Binnersley

[11] Patent Number: 5,212,841

[45] Date of Patent: May 25, 1993

[54] CARRY-COT AND CASE

[76] Inventor: George J. Binnersley, 30 Slaidburn Street, London, SW10 OJP, United Kingdom

[21] Appl. No.: 777,380

[22] Filed: Jan. 14, 1992

[30] Foreign Application Priority Data

May 24, 1989 [GB] United Kingdom ..... 8911943.2

[51] Int. Cl.[5] ..... A47C 29/00

[52] U.S. Cl. ..... 5/99.1; 190/2

[58] Field of Search ..... 5/94, 102, 99.1; 190/2

[56] References Cited

U.S. PATENT DOCUMENTS

| | | | |
|---|---|---|---|
| 33,628 | 11/1861 | Andrews | 5/112 |
| 325,879 | 9/1885 | Vuitton | 5/112 |
| 1,420,782 | 6/1922 | Suski | 190/2 |
| 1,714,878 | 5/1929 | Kita | 5/112 |
| 2,514,644 | 7/1950 | Irving | 5/99.1 |
| 2,738,521 | 3/1956 | Billgren | 5/99.1 |
| 3,699,594 | 10/1972 | Matthey-Doret | 5/99.1 |
| 3,722,009 | 3/1973 | Hrynda | 5/99.1 |
| 4,044,411 | 8/1977 | Peterson | 5/99.1 |
| 4,057,283 | 11/1977 | Barnett | 190/2 |
| 4,692,952 | 9/1987 | Fetters | 5/99.1 |

FOREIGN PATENT DOCUMENTS

| | | | |
|---|---|---|---|
| 395979 | 5/1924 | Fed. Rep. of Germany | 190/2 |
| 466903 | 5/1914 | France | 190/2 |

*Primary Examiner*—Peter M. Cuomo
*Assistant Examiner*—Michael J. Milano
*Attorney, Agent, or Firm*—Olson & Hierl

[57] ABSTRACT

A collapsible carry cot is erectable to stand within an open case 16. The cot comprises a telescopic strut 14 secured to each corner of the case. The struts support flexible sidewalls 24 on spurs 12. In the collapsed state the cot is received wholly within the case and is designed to occupy those areas of the case, such as the corners, which are not usually as densely packed in a conventional case. The remainder of the case is left free for items to be stowed in the case.

8 Claims, 1 Drawing Sheet

CARRY-COT AND CASE

Figure 1:
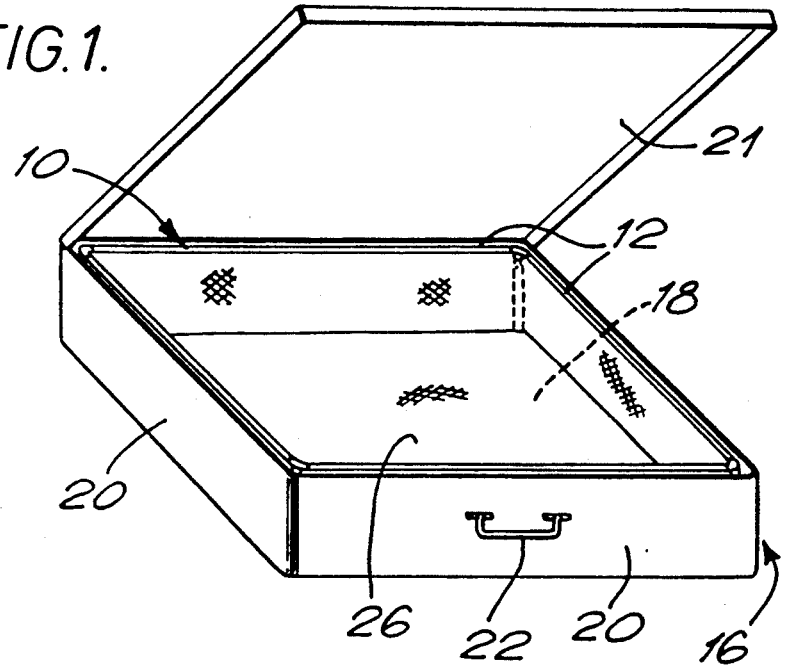

This invention relates to carry-cots for infants.

Travelling with a baby or small child is made more difficult because of the number of items that have to be taken along to cater for their various needs. Not all the items are at all conveniently sized. Notable amongst these is the carry-cot in which a baby or small child has to sleep before they are able to sleep in a normal bed. Most cots comprise a base and high cot walls which prevent the occupant falling out.

Efforts have been made to make an infant's cot portable, i.e. into a carry-cot. This has centred around making it collapsible, most notably so that the walls can be collapsed to lie adjacent and generally parallel to the base. However, while known collapsible carry-cots are more easily stowed in this flattened form they are not particularly portable due to their awkward size and considerable weight. Furthermore, while they are more stowable, there reduced size in the collapsed form still takes up a considerable amount of space, for example in the boot of a car, which could be better utilised occupied by other luggage.

It is an object of the present invention to provide a carry-cot arrangement that is both light and conveniently portable in its collapsed state. It is also an object of the present invention to provide a carry-cot that, when stowed, occupies a minimum of useful space that could otherwise be used.

According to the present invention there is provided a collapsible carry-cot comprising, in an erect form, a plurality of cot walls, the cot being collapsible into a collapsed form in which the cot is receivable within a carrying case, the case having a base, side walls, a closable lid and carrying means by which the cot and case may be held, the cot being erectable to stand within the case when the lid is open.

The present invention may equally well be considered as a luggage case having a base, side walls, a closable lid and carrying means by which the case may be held, the case including a collapsible cot comprising in an erect form, a plurality of cot walls, the cot being collapsible into a collapsed form in which the cot is receivable within the case, and the cot being erectable to stand within the case when the lid is open.

Thus, the collapsible cot is significantly more easily carried when it is stowed in the case. Furthermore, the volume of the case does not have to be totally occupied by collapsed cot. The remaining space can usefully be used to store other items normally carried in a case. The case also provides a stable base on which the carry-cot may be erected. Preferably, the base of the cot is constituted by the base of the case. In order to maximise the space available in the case for other items it is preferable that the collapsed cot conforms generally to the adjacent shape of the case.

Preferably, each of the cot walls are constituted by a flexible sheet which is held in shape, in the erect form, by a supporting cot frame. However, in an alternative embodiment the cot walls may each comprise a rigid or semi-rigid sheet. The sheets being securable together to constitute the cot. In this case, the rigid sheets may be hinged to the base of the case.

Preferably, the frame comprises a supporting spar or strut for each cot wall, the plurality of struts being supported, in the erect form, by legs standing in the case. The legs may be secured to the case either at the base or side walls, or both, or they may be free standing within the case.

Conveniently, the legs may be telescopic such that they are collapsible into the case at each corner thereof. The corners of a case are very often less densely packed than the rest of the case. Thus, the space occupied by the collapsed frame and flexible cot walls does not encroach significantly on the remaining packing space within the case.

When the frame is collapsed it is preferable that the supporting spars are disposed just beneath the level of the side walls adjacent the closed lid.

Preferably, the carry-cot also comprises a mattress resting on the base of the case.

Figure 2:
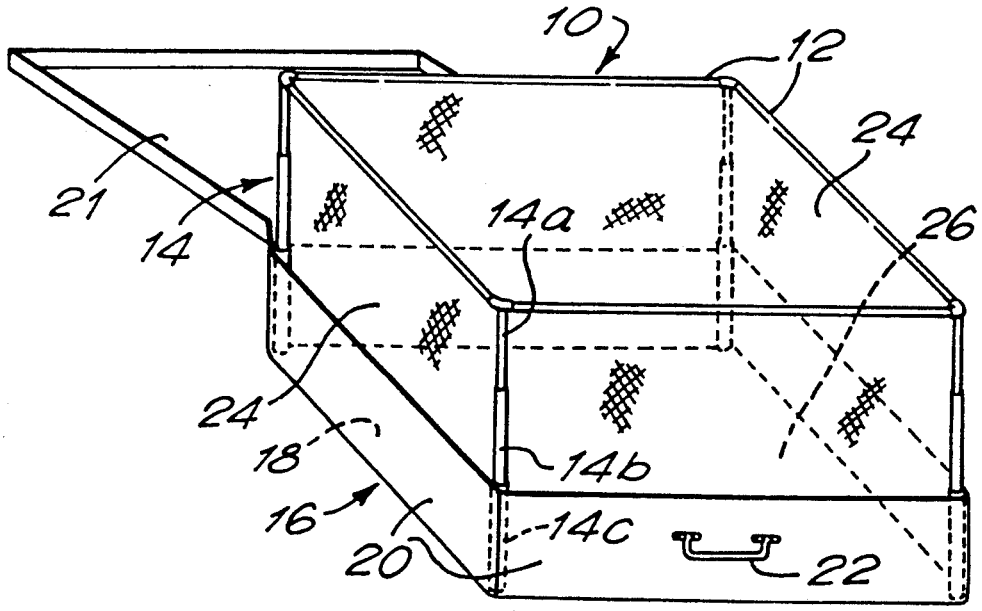

The present invention can be put into practice in various ways some of which will now be described by way of example with reference to the accompanying drawings in which:

FIG. 1 is a perspective view of a carry-cot in its collapsed state, within a case; and FIG. 2 is a perspective view of the carry-cot of FIG. 1 in the erect state.

Referring to FIGS. 1 and 2, a carry-cot comprises a collapsible frame 10 having four connected supporting aluminium spars 12 defining a rectangle which is supported on four telescopic aluminium legs 14 attached at each corner of the connecting spars 12. Each of the legs comprises three telescopic sections 14*a*, 14*b*, 14*c*. The legs 14, depending from the spars 12, are secured in each corner of a suitcase 16.

The suitcase comprises a base 18, rigid side walls 20 and a lid 21 which is hinged about the upper edge of that side wall on the opposite side of the case from a carrying handle 22 to close the case. In this embodiment the suitcase is of generally conventional manufacture. The closing of the lid may be effected by tab locks, a zip, straps or any other convenient means. The sides, base and lid may be flexible or rigid in common with conventional suitcases. The cot is provided with a mattress (not shown) which is laid inside the suitcase 16 and conforms generally to the dimensions of the base.

In this embodiment, the legs 14 are each secured in a respective corner of a suitcase by adhesive. However, it is equally possible for the side walls 20 and/or base 18 of the suitcase to be moulded or otherwise adapted to receive and secure the legs in place, either permanently or temporarily while the carry-cot frame is in the erect form. Indeed, it may be preferable in some applications to arrange for the cot frame to be easily removable from the case so that the latter is able to revert to normal use.

The spars 12 support flexible cot walls 24 which, in this embodiment, are made of cotton. However, any suitable flexible material can be used, such as, for example, netting or woven or non-woven plastics. The cot walls are sewn together around either the inside or outside of the legs 14. The material of the cot walls 24 also extend into the middle of the cot to provide a cover 26 for the base of the case.

Referring particularly to FIG. 1, in the collapsed state the three sections 14*a*, 14*b*, 14*c* of each telescopic leg 14 are retracted. The spars 12 of the frame 10 lie just below the lip of the side walls 20 remote from the base 18. In this collapsed form, the cot takes up a minimal amount of volume of the case. The lid 21 may thus be closed in the normal way. Indeed, as a practical matter it is found that the collapsed frame 10 occupies those spaces, namely the corners and the top outer edges of the suitcase, that are normally less well, i.e. less densely, utilised to accommodate other items. Thus, the form of the collapsed frame 10 is particularly efficient in conserving the main space used for those other items which will be packed in the suitcase.

To erect the cot the telescopic legs 14 are extended to raise the spars 12 to a height of about 1 meter above the base 18 of the suitcase 16. Raising the legs 14 causes the fabric of the cot walls to be straightened out and adopt the generally box shape defined by the spars and legs.

In the erect form each telescopic leg 14 is locked. In this embodiment the locking is achieved by threaded engagement between a compression nut and the top of an adjacent section of the leg 14 which compresses a rubber washer radially inwardly to inhibit relative movement between the sections. However, locking of the sections may be achieved by any suitable means, such as spring clips.

The base 18 of the suitcase 16 provides a stable platform for the cot. Clearly, in this embodiment the dimensions of the cot are dictated by the dimensions of the suitcase 16. However, the suitcase may be provided with a hinged side wall which can be partly detached and folded down to allow either a major and/or a minor side of the cot to be extended out of the case. In this case, a more elaborate frame would be required which folded into the suitcase when the cot was not used. One way of achieving this would be to make the appropriate spars telescopic as well as the legs.

In another embodiment the cot walls may be constituted by four plastics or other rigid sheets which are hingedly attached to the base of the suitcase or simply locatable within the space defined by the case and securable together. The sheets may be laid flat on the base of the suitcase to take up a minimal amount of space.

Alternatively, the sections of the legs 14 may be hinged together instead of being telescopic. Also, the spars 12 may be detachable from the legs and further collapsible either by being hingedly secured together or telescopically compressible. The legs may be collapsible by being folded alongside adjacent side walls of the suitcase.

I claim:

1. A combination of a collapsible carry-cot and case, the collapsible carry-cot comprising, in an erect form, a plurality of cot walls, a cot base, and telescopic legs supporting the cot walls, each leg being secured in a corresponding corner of the case, each of the cot walls comprising a flexible sheet, each sheet being supported by a cot frame including the telescopic legs, the cot being collapsible to a collapsed form in which the cot is receivable within the case, the case including a base, side walls, a closable lid and carrying means by which the case may be carried, the cot being erectable to stand only within the base of the case when the lid is open, such that the cot base comprises the base of the case.

2. A combination as claimed in claim 1 in which the frame comprises a supporting spar for each cot wall, the plurality of spars being supported, in the erect form, by legs standing in the case.

3. A combination as claimed in claim 2 in which the legs are attached to the base or the sides of the case.

4. A combination as claimed in claim 1 in which the frame is collapsible beneath the level of the side walls adjacent the opening closed by the lid.

5. A combination as claimed in claim 1 in which a mattress is disposed on the base of the case.

6. A combination as claimed in claim 1 in which the collapsed cot conforms generally to the adjacent shape of the case.

7. A combination as claimed in claim 1 in which the carrying case is a suitcase.

8. A combination of a collapsible carry-cot and suitcase, the suitcase comprising a base, side walls, a closeable lid and carrying means by which the suitcase may be carried, the collapsible carry-cot comprising: in an erect form, a plurality of flexible cot walls, each cot wall being generally adjacent to a corresponding side of the suitcase; a frame to which the flexible cot walls are secured; and a telescopic support for the frame in each corner of the case, each of the cot walls comprising a flexible sheet, each sheet being supported by the frame including the telescopic legs, the cot being erectable by extending the telescopic supports, the cot standing only within the base of the case when the lid is opened, such that the cot base consists of the base of the case.

* * * * *